United States Patent [19]

Vuilleumier et al.

[11] Patent Number: 4,926,401

[45] Date of Patent: May 15, 1990

[54] SKELETON WATCH ALLOWING SIGHT OF ALL OR SOME OF THE ELEMENTS FORMING IT

[75] Inventors: Cyril Vuilleumier, Bienne; Jacques Müller, Reconvilier, both of Switzerland

[73] Assignee: ETA SA Fabriques, Grenchen, Switzerland

[21] Appl. No.: 410,886

[22] Filed: Sep. 22, 1989

[30] Foreign Application Priority Data

Sep. 23, 1988 [CH] Switzerland ..... 3555/88

[51] Int. Cl.[5] ..... G04C 23/02; G04B 19/20

[52] U.S. Cl. ..... 368/88; 368/223; 368/309

[58] Field of Search ..... 368/76, 77, 80, 88, 368/223, 228, 233, 234, 318, 297–300, 309

[56] References Cited

U.S. PATENT DOCUMENTS

| | | | |
|---|---|---|---|
| 4,182,114 | 1/1980 | Gagnebin | 58/59 |
| 4,362,397 | 12/1982 | Klingenberg | 368/234 |
| 4,376,996 | 3/1989 | Wuthrich | 368/220 |
| 4,382,690 | 5/1983 | Erard | 368/233 |
| 4,407,586 | 10/1983 | Musy | 368/233 |
| 4,459,032 | 7/1984 | Musy | 368/234 |
| 4,475,822 | 10/1984 | Müller et al. | 368/88 |

FOREIGN PATENT DOCUMENTS 2461292 7/1979 France .

OTHER PUBLICATIONS

Journal Suisse d'Horlogerie et de Bijouterie (1987, No. 4, Lausanne, Switzerland).

*Primary Examiner*—Vit W. Miska

*Attorney, Agent, or Firm*—Griffin, Branigan & Butler

[57] ABSTRACT

The skeleton watch of this invention includes a caseband (1) bearing a frame (6) arranged between an upper crystal and a back cover (26), a leg (8) contiguous to the frame, a motor (10, 11, 12) secured to the frame and including a rotor directly driving a minutes wheel (15) bearing a minutes marker (17). An hours hand (18) is driven by the minutes wheel through motion work including a train of planetary gears (23, 24). Zones (27 to 32) and conductors (33 to 37) are metallized on the internal face of the back cover and are intended respectively to accommodate the electrical and electronic components and establish connections among such components. The arrangement as set forth permits a greatly bared skeleton watch with a minimum of noticeable elements.

16 Claims, 4 Drawing Sheets

26

SKELETON WATCH ALLOWING SIGHT OF ALL OR SOME OF THE ELEMENTS FORMING IT

This invention concerns a skeleton watch allowing sight of all or some of the elements forming it.

BACKGROUND OF THE INVENTION

Such watches have long been known. In the most elementary fashion, it is sufficient to remove the dial from the watch in order to allow the mechanism forming it to come into view. At this point, however, only parts of the mechanism will appear since certain elements will be hidden from view by the base plate and the bridges which maintain the wheel trains assembled. Then it was proposed to perforate the base plate and bridges to the extent possible in order to render visible the elements hidden thereunder. One thus arrived at the watch referred to as a skeleton watch, allowing one to see most of the elements forming it. This type of watch seeks above all to show the large number of elements which go together to form it and with what complexity such elements are intermingled. This in particular is the case for chronographs or complicated watches.

Up to the present, however, it has never been suggested to propose a skeleton watch provided with a movement controlled by a stepping motor, itself controlled in a well-known manner by a quartz time base. This is the approach of the present invention which enables exhibiting the extreme simplicity of the arrangements of an electronic watch, particularly if one chooses for such watch a well-defined set of characteristics for the most part in themselves well known. One thus obtains a timepiece with a surprising effect, i.e. giving the impression that it includes almost no parts and that it displays time by means of elements remaining mysterious although directly visible to the eyes of the observer. The invention thus proposes a mostly empty skeleton watch with no particular ornamentation, the space circumscribed by its caseband being made up of empty zones the total extent of which is much more substantial than that of the zones occupied by the elements necessary for operation of the watch.

SUMMARY OF THE INVENTION

In order to arrive at this result, the watch of this invention, in a first embodiment thereof, includes

- a caseband bearing an upper crystal and a back cover,
- a frame contiguous to the caseband and arranged in the space circumscribed by the caseband between the upper crystal and the back cover,
- a leg contiguous to the frame and extending toward the center of rotation of the watch display organs, said leg covering at least said center,
- a motor secured to the frame and including a rotor directly driving a minutes wheel bearing a minutes marker,
- a fixed pinion driven into an orifice provided in the leg at the location of the center of rotation of the display organs,
- a shaft united with said fixed pinion around which are pivotally mounted the minutes wheel and an hours wheel bearing an hours marker, said minutes wheel carrying first and second coaxial planet pinions displaced from its center, the first planet pinion meshing with the fixed pinion and the second planet pinion meshing with the hours wheel,

- zones and conductors metallized on the internal face of the back cover intended respectively to accommodate the electrical and electronic components necessary for the operation of the watch and to establish connections among such components, and
- a time setting arrangement.

In a second embodiment of the invention, the watch includes in combination:

- a caseband bearing an upper crystal and a back cover,
- a leg contiguous to the caseband and extending toward the center of rotation of the watch display organs, said leg covering at least said center and emerging in the space circumscribed by the caseband between the upper crystal and the back cover,
- a motor secured to the caseband and including a rotor directly driving a minutes wheel bearing a minutes marker,
- a fixed pinion driven into an orifice provided in the leg at the center of rotation of said display organs,
- a shaft united with said fixed pinion around which are pivotally mounted the minutes wheel and an hours wheel bearing an hours marker, the minutes wheel carrying first and second coaxial planet pinions displaced from its center, the first planet pinion meshing with the fixed pinion and the second planet pinion meshing with the hours wheel,
- zones and conductors metallized on the internal face of the back cover intended respectively to accommodate the electrical and electronic components necessary for the watch operation and to establish connections among said components, and
- a time setting arrangement.

The invention will now be explained with the help of the description which follows given by way of example in referring to the attached drawings.

DESCRIPTION OF THE PREFERRED EMBODIMENTS

Figure 1:
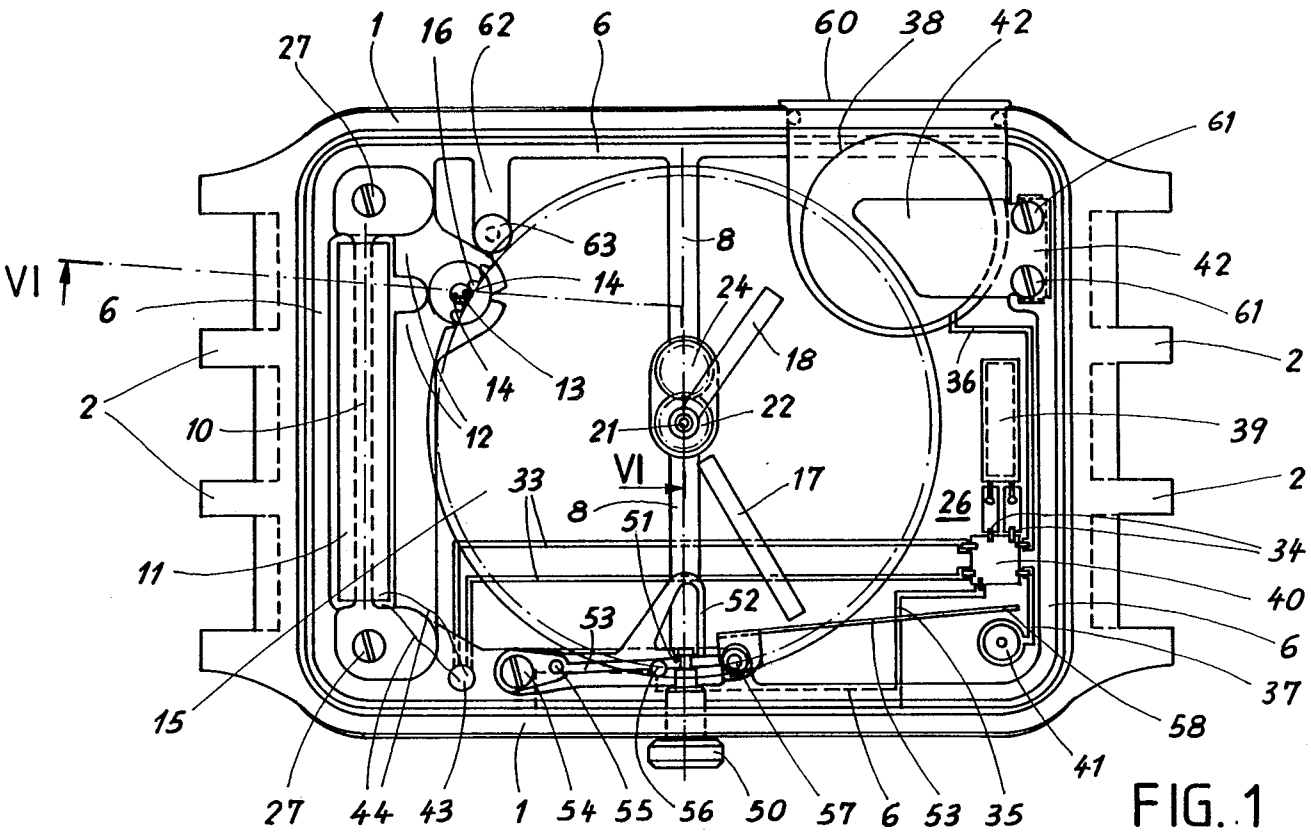
FIG. 1 is a top view of the watch according to the invention with the upper crystal removed.
Figure 2:
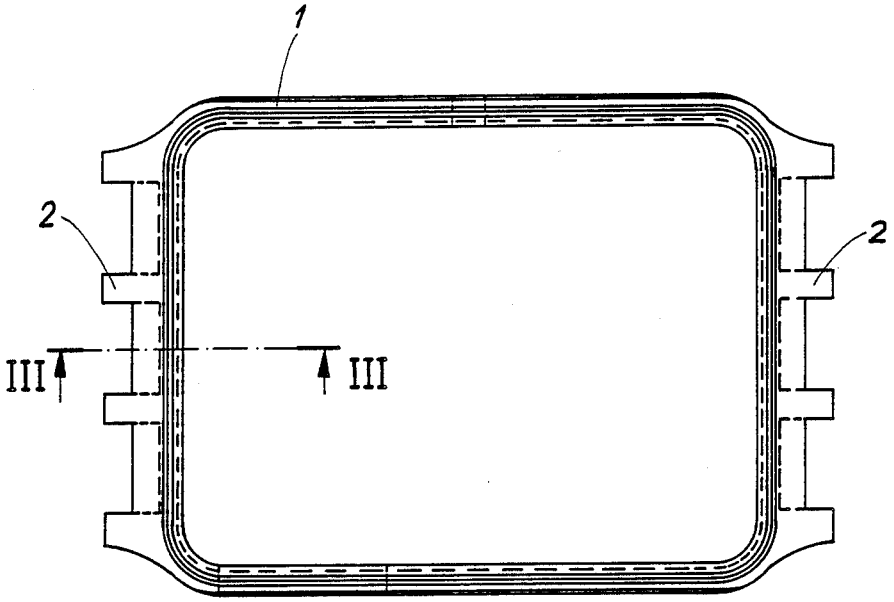
FIG. 2 is a plan view of the caseband of the watch shown on FIG. 1.
Figure 3:
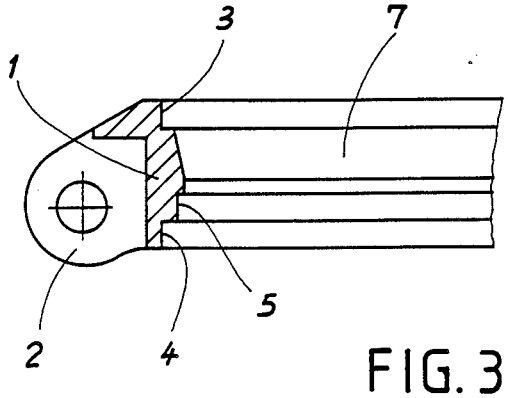
FIG. 3 is a cross-section along line III—III of FIG. 2.

The watch shown on FIG. 1 has a caseband 1 provided with lugs 2 intended to attach a bracelet. Here the caseband is of rectangular form, but could also be round or of still some other form. The caseband is shown alone on FIGS. 2 and 3. It is provided with accommodations 3 and 4 which are respectively intended to receive an upper crystal 25 and a back cover 26 as may be seen on FIG. 6. The caseband further provides an accommodation 5 intended to receive a frame 6 shown alone on FIG. 4 and arranged within space 7 circumscribed by the caseband between the crystal and the back cover. The frame 6 is maintained on the caseband 1 by the back cover 26, itself secured to the caseband in the accommodation 4 by gluing or by driving into a seal (not shown). As may also be seen on FIG. 4, a leg 8 is contiguous to frame 6. This leg extends towards the center of rotation 9 of the display organs of the watch and covers at least this center. In the embodiment shown, the leg comprises a bridge connected to opposite edges of the frame and is integrally formed with such frame. The frame thus presented may be said to form the base plate of the watch on which are mounted in any case the mechanical elements such as the display organs and the electric motor.

Following discussion of these preliminaries, reference will now be had to FIG. 1 which illustrates the manner in which the watch is constructed.

Fastened to frame 6 by means of screw 27 is a stepping motor illustrated by its core 10, winding 11, stator 12 and axis 13 of its rotor. This motor, the cross-section of which appears on FIG. 6, forms a unit in and of itself, its rotor pivoting in bearings fixed to its stator as may be seen for instance in the Swiss patent document CH-A-639 525 (US-A-4 483 627). This manner of construction avoids providing bearings which would otherwise form a part of the frame or the bridges fixed to this frame thus to encumber the construction and depart from the desired sense of a mostly empty arrangement. Fixed to the rotor of the motor are to be found two fingers 14 which directly drive a large minutes wheel 15 by its peripheral teeth 16. The minutes wheel is advantageously a transparent disc bearing a minutes marker 17. It is thus employed directly as a display organ for minutes. In a practical example the minutes wheel bears 180 teeth and three pulses per minute drive the motor.

The hours display is obtained by an hours hand 18 coupled to the minutes disc 15 by a gear train, the operation of which is shown in cross-section on FIG. 6 and which will now be explained.

Figure 4:
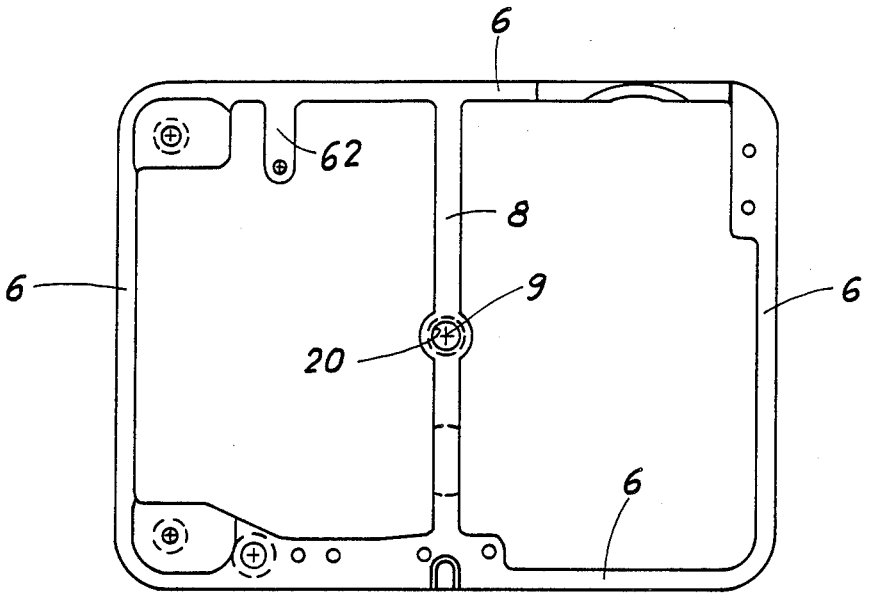
FIG. 4 is a plan view of the frame-base plate of the watch shown on FIG. 1.

A fixed pinion 19 is driven into an orifice 20 provided in leg 8 at the center of rotation of the display organs (see also FIG. 4). A shaft 21 is united with fixed pinion 19 or is formed integrally with said pinion. Around this shaft 21 are pivotally mounted the minutes wheel 15 as just described and an hours wheel 22 bearing the hours hand 18. The minutes wheel 15 carries first 23 and second 24 coaxial planet pinions displaced from its center, the first of these being in mesh with the fixed pinion 19 and the second with the hours wheel 22. Such an arrangement has the advantage of great simplicity and at the same time a substantially reduced volume and contributes greatly to the mysterious aspect of the operation of the watch according to the invention. Such an arrangement is known in itself from Swiss patent document CH-A-615 066 (US-A4 182 114) and the reader should refer to this document if further details are wished.

Figure 6:
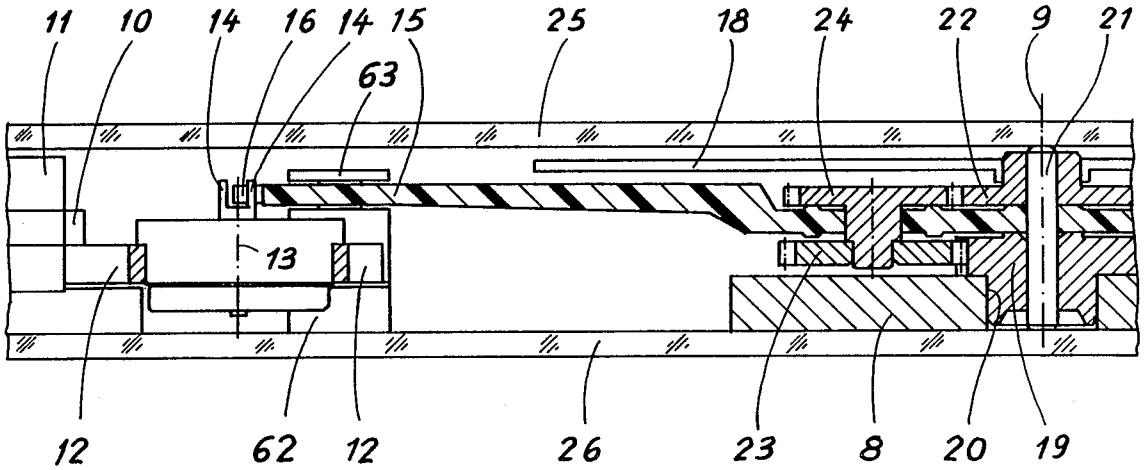
FIG. 6 is a cross-section along line VI—VI of FIG. 1.

FIG. 6 further shows that the length of shaft 21 is chosen in a manner such that it forms a support between the bottom of the crystal 25 and the internal face of the back cover 26. This arrangement maintains a constant distance between crystal and back cover. In view of such arrangement, bending of the crystal and back cover is prevented and absence thereof could bring about breaking of one or the other of these elements when they are subject to exterior pressure. This arrangement likewise enables the moving elements between the crystal and the back cover to have complete liberty of movement.

Figure 5:
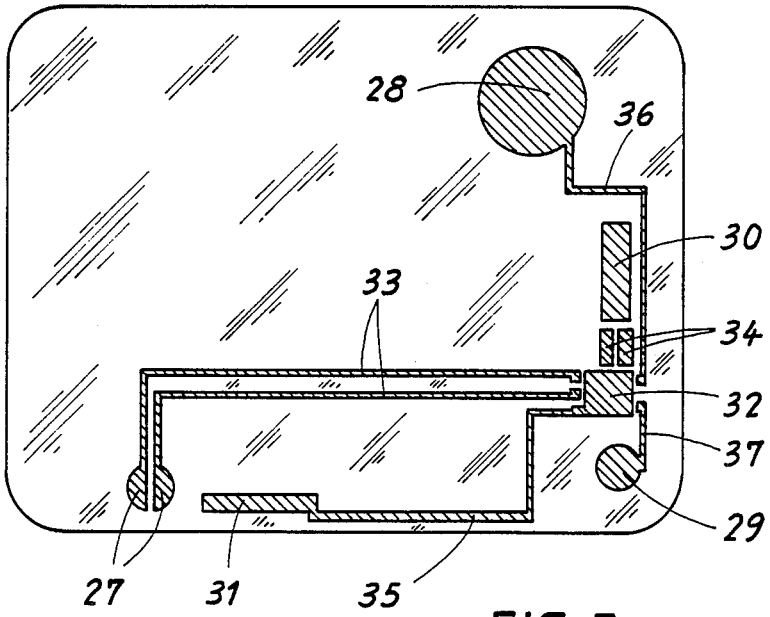
FIG. 5 is a plan view of the internal face of the back cover of the watch of FIG. 1.

If one now refers to FIGS. 1 and 5, one will note that zones (27 to 32) and conductors (33 to 37) are metallized on the internal face of the back cover. Zone 28 is intended to receive the negative electrode of a battery 38 which is connected to an integrated circuit 40 (under which is located zone 32) via a conductor 36. A contact stud 41 is accommodated by zone 29 which is connected to the integrated circuit 40 by conductor 37. A quartz 39 is accommodated by zone 30 placed here for reasons of appearance. The terminals of the quartz are soldered to conductors 34 which connect the quartz to the integrated circuit 40. Zone 31 serves to connect via the frame, the conductor 35 and a contact tab 42, the positive electrode of battery 38 to the integrated circuit 40. Finally, zones 27 connected to the integrated circuit by conductors 33 are intended to come into contact with a plug 43 going through frame 6 to which plug are soldered the wires 44 of the winding 11 of the stepping motor.

The connection arrangement which has just been described employs partially the invention as set forth in Swiss patent document CH-A-636 744 (US-A-4 475 822) and enables rendering less visible the connection arrangement necessary for the operation of the watch.

The watch in accordance with the invention is provided with a time setting arrangement making use of a stemcrown 50 which may assume a pushed-in rest position (that shown on FIG. 1) or a drawn-out working position. To this end the stem bears an annular accommodation 51 at one of its ends. This accommodation cooperates on the one hand with a jumper spring 52 defining the two positions mentioned hereinabove and on the other hand, mounted over the jumper spring, a contact blade 53. The jumper spring 52 is secured to the frame by means of screw 54 and positioned by means of pins 55 and 56. The contact blade 53 is likewise secured to the frame by means of screw 54 and positioned by means of pin 55 and of a stepped screw 57 under the head of which this blade may be displaced. In the drawn-out position of the stem it is understood that the end 58 of blade 53 comes into contact with stud 41 advantageously arranged on the metallization 29 carried by the back cover 26. The integrated circuit 40 may be provided with the same functions as those described in Swiss patent document CH-A-617 059 (US-A-4 185 453). In this case if one retains the stem in the drawn-out position during less than the predetermined time lapse (for instance four seconds), the minutes disc will advance by a single step of one minute and if such stem is retained in its drawn-out position during a longer period than said predetermined lapse of time, the minutes disc will advance through 60 steps of one minute.

In a general manner, one will note that the fastening and positioning means of the jumper and the contact blade are substantially located in a plane perpendicular to the axis of the stem-crown in a manner such that they do not encroach upon the space circumscribed by the frame and this bearing in mind the objective of this invention to provide a skeleton watch as empty as possible and showing a maximum amount of space devoid of elements.

The back cover 26 of the watch may be provided of metal or of coloured plastic material. It is however possible to employ a transparent material, for instance sapphire glass. In this case the skeleton watch could also be referred to as a transparent watch.

The employment of a sapphire crystal for the back cover 26 necessarily requires a battery accommodation having a lateral opening provided in the caseband. This is arranged as may be seen on FIG. 1, where the battery is contained within a drawer 60 which may be removed from the watch by the user himself. Under the upper crystal is located the contact tab 42 fastened to the frame 6 by means of two screws 61.

The minutes wheel 15 is preferably provided of transparent material, toothed over its periphery, thus bringing out the skeleton character of the watch. One could however use other forms, for instance a metallic spoked wheel, the planet pinions being pivotally mounted on one of the spokes. Whatever be the manner of providing this wheel it will be advantageous to guide it in a manner such that the teeth 6 are situated at the same level as the fingers 14 fixed to the rotor of the motor. To this effect frame 6 bears a small bridge 62 at the end of which is located a guiding stud 63.

The description which has just been given of the skeleton watch mentions a frame 6 arranged between the upper crystal and the back cover and concerns a first embodiment of the invention. It will be however understood that this independent frame could be eliminated and that the elements of the watch (motor 12, leg 8, time setting arrangement 50, 52, 53, battery contact tab 42, etc.) could be directly contiguous to caseband 1 in providing such caseband with the necessary projections similar to those provided on the frame of the first embodiment. One thus arrives at a second embodiment of the invention which is illustrated by the same FIG. 1 which has served to describe the first embodiment.

What we claim is:

1. A skeleton watch allowing sight of all or some of the elements forming it including in combination:

a caseband bearing an upper crystal and a back cover, a frame contiguous to the caseband and arranged in the space circumscribed by the caseband between the upper crystal and the back cover, a leg contiguous to the frame and extending toward the center of rotation of the watch display organs, said leg covering at least said center, a motor secured to the frame and including a rotor directly driving a minutes wheel bearing a minutes marker, a fixed pinion driven into an orifice provided in the leg at the location of the center of rotation of the display organs, a shaft united with said fixed pinion around which are pivotally mounted the minutes wheel and an hours wheel bearing an hours marker, said minutes wheel carrying first and second coaxial planet pinions displaced from its center, the first planet pinion meshing with the fixed pinion and the second planet pinion meshing with the hours wheel, zones and conductors metallized on the internal face of the back cover intended respectively to accommodate the electrical and electronic components necessary for the operation of the watch and to establish connections among such components, and a time setting arrangement.

2. A watch as set forth in claim 1 wherein the minutes wheel is a transparent toothed disc.

3. A watch as set forth in claim 1 wherein the frame takes up space in a corresponding accommodation within the caseband.

4. A watch as set forth in claim 1 wherein the back cover is a crystal.

5. A watch as set forth in claim 1 wherein the leg is integrally formed with the frame.

6. A watch as set forth in claim 1 wherein the leg is a bridge connecting two opposite edges of the frame.

7. A watch as set forth in claim 1 wherein the shaft united with the fixed pinion is of a length chosen in a manner such that said shaft provides a brace between the bottom of the upper crystal and the back cover.

8. A watch as set forth in claim 1 wherein the time setting arrangement includes a stem and crown arranged to assume a pushed-in rest position and a drawn-out working position, said stem bearing on one end thereof an annular accommodation cooperating with a jumper spring and a contact blade, said jumper spring and contact blade including fastening and positioning means on the frame arranged in manner such as to be substantially accommodated in a plane perpendicular to the axis of said stem.

9. A watch as set forth in claim 8 wherein the contact blade comes into contact with a contact stud arranged on the metallization of the back cover whenever the stem is in the drawn-out position.

10. A skeleton watch allowing sight of all or some of the elements forming it including in combination:

a caseband bearing an upper crystal and a back cover, a leg contiguous to the caseband and extending toward the center of rotation of the watch display organs, said leg covering at least said center and emerging in the space circumscribed by the caseband between the upper crystal and the back cover, a motor secured to the caseband and including a rotor directly driving a minutes wheel bearing a minutes marker, a fixed pinion driven into an orifice provided the leg at the center of rotation of said display organs, a shaft united with said fixed pinion around which area pivotally mounted the minutes wheel and an hours wheel bearing an hours marker, the minutes wheel carrying first and second coaxial planet pinions displaced from its center, the first planet pinion meshing with the fixed pinion and the second planet pinion meshing with the hours wheel, zones and conductors metallized on the internal face of the back cover intended respectively to accommodate the electrical and electronic components necessary for the watch operation and to establish connections among said components, and a time setting arrangement.

11. A watch as set forth in claim 10 wherein the minutes wheel is a transparent toothed disc.

12. A watch as set forth in claim 10 wherein the back cover is a crystal.

13. A watch as set forth in claim 10 wherein the leg is integrally formed with the caseband.

14. A watch as set forth in claim 10 wherein the leg is a bridge connecting two opposite edges of the caseband.

15. A watch as set forth in claim 10 wherein the time setting arrangement includes a stem and crown arranged to assume a pushed-in rest position and a drawn-out working position, said stem bearing an annular accommodation on one end thereof cooperating with a jumper spring and a contact blade, said jumper spring and contact blade including fastening and positioning means on the frame arranged in a manner to be substantially accommodated in a plane perpendicular to the axis of said stem.

16. A watch as set forth in claim 15 wherein the contact blade comes into contact with a contact stud arranged on the metallization of the back cover whenever the stem is in the drawn-out position.

* * * * *